US005466068A

United States Patent [19]

Andrä et al.

[11] Patent Number: 5,466,068

[45] Date of Patent: Nov. 14, 1995

[54] ARTICULATED BEARING FOR HEAVY LOADS

[76] Inventors: Hans P. Andrä, Im Betzengaiern 40; Wolfhart Andrä, Dornhalde 16, both of D-7000 Stuttgart, Germany

[21] Appl. No.: 162,082

[22] PCT Filed: Jun. 11, 1992

[86] PCT No.: PCT/EP92/01311

§ 371 Date: Jan. 6, 1994

§ 102(e) Date: Jan. 6, 1994

[87] PCT Pub. No.: WO92/22708

PCT Pub. Date: Dec. 23, 1992

[30] Foreign Application Priority Data

Jun. 13, 1991 [DE] Germany ..... 41 19 458.6

[51] Int. Cl.[6] ..... F16C 29/02

[52] U.S. Cl. ..... 384/36; 14/73.5; 52/167.1

[58] Field of Search ..... 384/36, 37, 38; 14/73.5; 52/167.1

[56] References Cited

U.S. PATENT DOCUMENTS 3,806,975 4/1974 Fyfe ..... 14/16
3,934,295 1/1976 Koster et al. ..... 14/16
4,006,505 2/1977 Köster et al. ..... 384/36
4,610,431 9/1986 Andrä et al. ..... 254/93 HP
5,071,261 12/1991 Stüve ..... 384/36

FOREIGN PATENT DOCUMENTS 2152981 5/1973 Germany .

*Primary Examiner*—Lenard A. Footland
*Attorney, Agent, or Firm*—Burns, Doane, Swecker & Mathis

[57] ABSTRACT

An articulated bearing for the articulated transfer of heavy loads, e.g., from a bridge superstructure to a bearing pad, includes a pot connected to the bearing pad and a cover connected to the bridge. The cover extends vertically into the pot to form a sealed space vertically therebetween. A deformable, non-compressible cushioning medium (e.g., liquid or plastic) occupies the space and is loaded by the cover. Horizontal forces are withstood by a journal formed on the cover (or on the pot) and extending into a recess formed in the pot (or in the cover). The journal extends within the recess for less than the recess height to form a gap which is also occupied by the deformable medium to maximize the supporting area of that medium. A channel communicates the gap and space to equalize the pressure of the medium.

22 Claims, 2 Drawing Sheets

ARTICULATED BEARING FOR HEAVY LOADS

BACKGROUND OF THE INVENTION

The invention relates to an articulated bearing for the articulated transfer of heavy loads to a support, in particular to brace a bridge superstructure on a bearing pad, with a bearing pot, which contains an incompressible, deformable pressurized material and rests on the support, said bearing pot comprising a pot bottom and a pot wall, and with a cover, which receives the load to be braced, rests on the pressurized material and is sealed with respect to the pot wall.

Such articulated bearings serve to transfer freely and easily large loads to a support. The bearings have to transfer both vertical and horizontal loads, yet allow tilting movements around arbitrary horizontal axes during most applications. These tilting joints are employed especially during bridge construction in order to support the superstructure on a bearing pad.

In the known articulated bearings which are also called "neo pot bearings" or "rubber pot bearings" the deformable pressurized material is a plastic material, which is enveloped on all sides by the bearing pot and the cover. The cover is braced in the vertical direction against the deformable pressurized material and in the horizontal direction against the pot wall. The pot wall is stressed by both the lateral pressure of the pressurized material and the external horizontal forces exerted through the cover. This horizontal stress necessitates that the pot wall and the connecting region at the pot bottom be quite thick.

Therefore, the object of the invention is to design an articulated bearing of the aforementioned class in such a manner that the wall of the bearing pot can be designed as small as possible.

This problem is solved according to the invention by further connecting the pot to the cover with a journal-and-recess connection and positioning the journal within only a portion of the height of the recess to form therein a vertical gap. The gap is also filled with the pressurized medium that occupies the main space formed between the cover and pot for maximizing the supporting area of the pressurized medium. Communication is provided between the gap and the main space for equalizing pressure therebetween.

Since the horizontal forces are transferred by means of the central bearing, the pot wall is relieved of these possibly very high horizontal forces and has only to absorb the side pressure of the deformable pressurized material. Apart from the relatively low sealing forces, no horizontal forces are transferred from the cover to the pot wall.

Since the horizontal forces are not introduced into the pot bottom in the connecting region of the pot wall, but rather in the middle of the pot bottom, the entire bearing pot can be designed with relatively small outer dimensions and—at least in the pot wall and the outer region of the pot bottom—with relatively low wall thickness, since even the flexural stresses in the region where the pot wall is connected to the pot bottom are relatively low.

Preferably the thickness of the pot bottom increases starting from the pot wall and going in the direction of the central horizontal bearing in order to introduce the horizontal forces from the horizontal bearing into the pot bottom without necessitating an increase in the outer dimensions of the articulated bearing.

The articulated bearing can be filled with the pressurized fluid as the pressurized material by means of a closable port in the pot wall or in the cover.

If a tilting Option is desired on all sides, the bearing journal is rotationally symmetrical and the bearing recess is a central bearing borehole. If, on the other hand, a tilting motion is required only around a single horizontal bearing axis, then the bearing journal according to the invention is a strip extending in essence over the width of the bearing pot, and the bearing recess is a bearing groove, with which this strip engages.

It has been demonstrated to be especially advantageous to provide in another embodiment of the inventive idea the bearing journal with a crowned outer surface, which forms preferably a spherical surface and which is braced horizontally against a cylindrical bore wall of the bearing borehole. Since virtually no vertical displacement can occur owing to the incompressibility of the deformable pressurized material, the bearing journal is stressed only by the hertzian compressive strains in the region of contact with the cylindrical bore wall of the bearing borehole.

Since there are no elements serving to the transfer horizontal forces between the circumference of the cover and the pot wall outside the pot seal, the construction of the articulated bearing is simplified and the assembly of the pot seal and articulated bearing become significantly easier. The pot seal lies in a groove and is self-sealing as a consequence of the lip resting against the pot wall.

BRIEF DESCRIPTION OF THE DRAWINGS

In the following the embodiments of the invention are explained in detail; they are depicted in the drawings from a vertical view.

DETAILED DESCRIPTION OF A PREFERRED EMBODIMENT OF THE INVENTION

Figure 1:
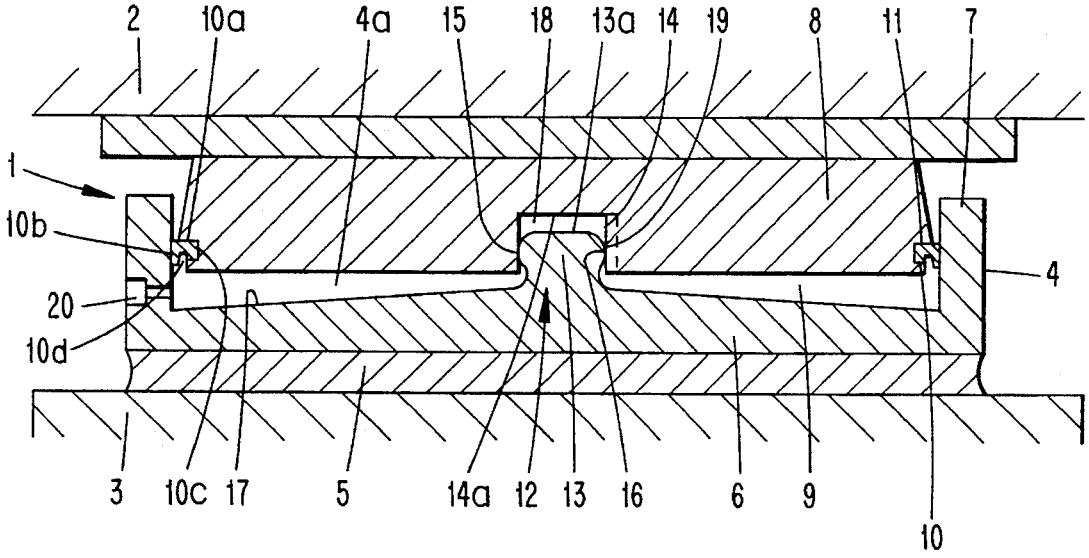
FIG. 1 is a vertical sectional view of articulated bearing with a bearing journal attached to the pot bottom.

FIG. 1 is a vertical view of a universally articulated bearing 1, which serves, for example, to brace a bridge superstructure 2 (i.e., a supported member) on a bearing pad 3 (i.e, a supporting member). The articulated bearing exhibits a bearing pot 4, which rests on an equalizing layer 5 on the bearing pad 3.

The bearing pot 4 exhibits a pot bottoms or end wall 6, from whose periphery projects upwardly a cylindrical pot side wall 7. The bearing pot 4 is closed by means of a cover 8, which is mounted to the bridge superstructure 2. The cover 8 projects into an upper opening of the pot 4.

An incompressible, deformable pressurized material 9, which can be a liquid or a plastic material, curing subsequently into readily deformable material, is enclosed in an interior space **4*a*, which is closed on all sides, between the cover 8 and the bearing pot 4. Between the circumference of the cover 8 and the pot wall 7 is a pot seal 10 (see also FIG. 2). The pot seal 10 allows the vertical shifts occurring between the cover 8 and the pot wall 7 with respect to the bearing pad 3 then the bridge superstructure 2 tilts. In the illustrated embodiment, the pot seal 10 exhibits a sealing ring 10***a* embedded in a circumferential groove 11 of the cover 8. The sealing ring 10*a* includes a groove 10*d* which is open toward the material 9 to divide the ring 10*a* into a lip portion 10*b* and a mounting portion 10*c*. The sealing lip 10*b* is snugly bearing against the pot wall 7, The surface of the groove 10*d* that is stressed by the internal pot pressure is so large compared to the surface exposed to the outer pressure that the sealing ring 10*a* forms a self-sealing pot seal; that is, the contact pressure of the sealing lip 10*b* at the inner surface of the pot wall 7 and thus the sealing effect increases as the internal pressure of the pressurized material 9 also rises.

A horizontal bearing 12, which transfers the horizontal forces between the cover 8 and the bearing pot 4, is disposed in the center of the bearing pot 4. The horizontal bearing 12 exhibits an upwardly projecting bearing journal 13, which is centered on the pot bottom 6 and engages with a recess in the form of a central bearing borehole 14 formed in the cover 8. The bearing journal 13 is provided on its circumference with a crowned outer surface 15, which in the illustrated embodiment is a spherical outer surface and is braced horizontally against a cylindrical bore wall 18 of the bearing borehole 14.

The top side 17 of the pot bottom 6 forms a flat truncated cone. The thickness of the pot bottom 6 increases starting from the pot wall 7 in the direction of the central horizontal bearing 12. Thus, the pot bottom 6 exhibits its greatest thickness in the middle, where the horizontal forces of the bearing journal 13 are introduced. Other than the sealing forces of the pot seal 10, and the horizontal forces from the side pressure of the pressurized material 9, no horizontal forces (e.g., form the cover 8) act on the pot wall 7.

Between the face 13*a* of the bearing journal 13 and the bottom 14*a* of the bearing recess 14 there is a gap 18, which is communicates by way of a channel 19 with the space 4*a* of the bearing pot 4. By means of the channel 19 the pressure is equalized between the space 4*a* and the space gap 18, so that the entire base of the cover 8 is loaded with the pressure of the pressure medium 9.

The pot wall 7 exhibits a closable port 20, through which the pressurized material 9 can be fed into the bearing pot 4. The embodiment shown in FIG. 2 differs from the embodiment 8 in FIG. 1 primarily due to the fact that the bearing journal 113 of the horizontal bearing 112 is attached to the cover 108 and engages within a bearing recess 114 in the middle of the pot bottom 106. The channel 119, which connects the gap 118 between the bearing journal 113 and the bearing recess 114 with the surrounding interior space 114*a*, is designed as a sloped borehole. Several such boreholes can be provided.

Figure 2:
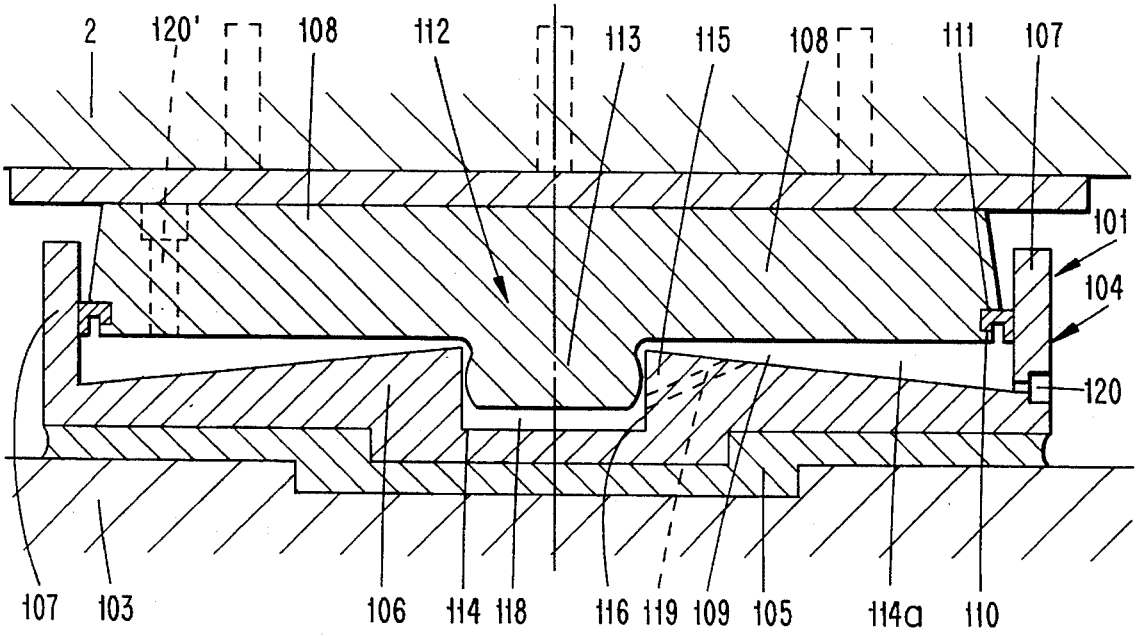
FIG. 2 is a vertical sectional of articulated bearing with a bearing journal attached to the cover.

It is also indicated in FIG. 2 that, in addition to the port 120 in the pot wall 107 or as an alternative to this port 120, a port 120' is provided in the cover 108. The pressurized material can be injected through the port 120' while assembling the articulated bearing. Moreover, all of the essentially identical components in the embodiments according to FIGS. 1 and 2, respectively are marked with the same reference numerals increased by one hundred.

Figure 3:
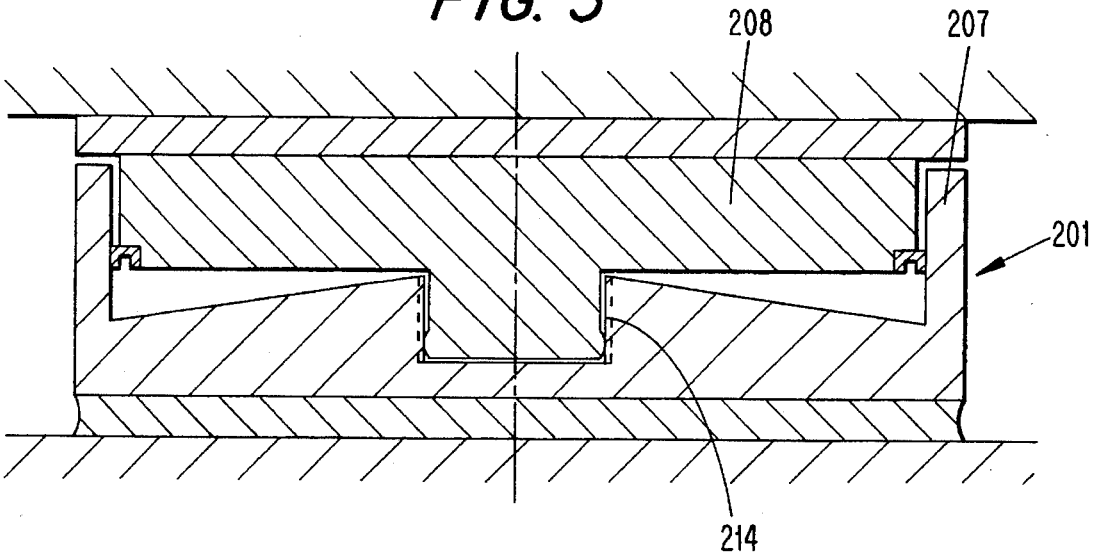
FIG. 3 is a vertical sectional view of raisable articulated bearing in its bottom position.
Figure 4:
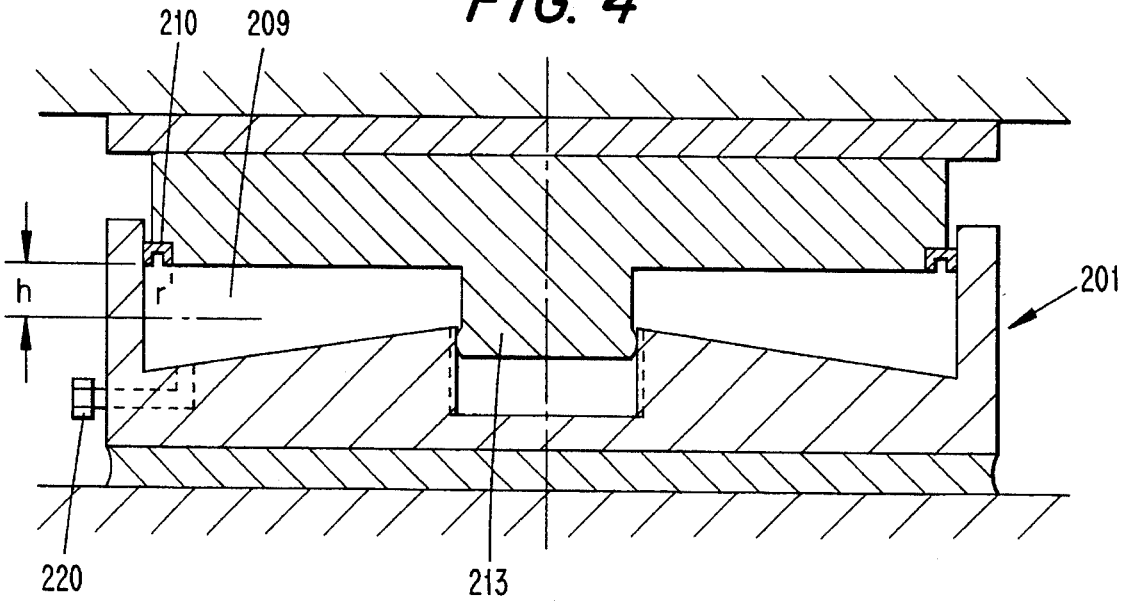
FIG. 4 is a vertical sectional view of the articulated bearing, according to FIG. 3, in its raised position.

The embodiment according to FIGS. 3 and 4 differs from the embodiment according to FIG. 2 primarly in that the pot wall 207, the bearing journal 213 and the side wall of the bearing recess 214 exhibit such a large height, that the cover 208 can be raised by feeding the pressurized material 209 through the side port 220 vertically to raise the cover 208 by a stroke height h from the position, shown in FIG. 3, into a position shown in FIG. 4, whereby the crowned outer surface of the bearing journal 213 remains engaged over the entire stroke with the side wall of the bearing recess 214. Similarly the seal 210 remains in sealing engagement with the pot wall 207 during the entire stroke.

In this embodiment the articulated bearing 1 is suitable for a vertical adjustment, as is sometimes necessary in bridge construction, for example, when laying the foundation. The cover 208 is raised by deliverying the pressurized material. In a corresponding manner an initially adjusted bearing height can also be decreased by releasing the pressurized material through the port 220.

If the pressurized material in the bearing pot 204 is no longer fluid, it can be liquefied again by briefly heating the bearing. To this end, a suitable pressurized material that can become liquid upon heating is selected. Identical elements of the embodiment according to FIGS. 2 and 3, respectively, are marked, with the same reference numerals increased by one hundred.

Figure 5:
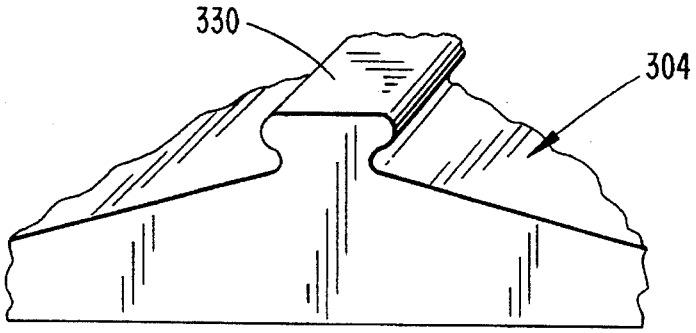
FIG. 5 is a fragmentary perspective view of an alternate form of bearing journal.

Universal articulated bearings that allow tilting movements in all directions were described as the embodiments, because the bearing journal 13 is rotationally symmetrical. The result is an especially advantageous loading on the pot bottom 6. If, on the other hand, a tilting option is required only around a single horizontal tilting axis, the bearing journal 13 is designed as a horizontal strip 330 that extends over the width of the bearing pot 304 and engages with the bearing groove forming the bearing recess as a shown in FIG. 5.

We claim:

1. An articulated bearing for the articulated transfer of heavy loads from an upper supported member and a lower supporting member, said bearing comprising:

a bearing pot mounted to one of said supporting member and said supported member and including a generally horizontal end wall and a generally vertical side wall forming a space, said space having an opening situated opposite said end wall;

a cover mounted on the other of said supporting member and said supported member and including a portion extending into said space through said opening to close said space;

a seal formed between said side wall and an outer periphery of said cover portion; and a deformable medium filling said space and being loaded vertically by said supported member;

one of said cover portion and said end wall including a recess disposed substantially centrally in said space;

the other of said cover portion and said end wall including a bearing journal extending into said recess along only a portion of the height of said recess to form a vertical gap between said bearing journal and said recess, said gap filled by said medium and being in communication with said space.

2. An articulated bearing according to claim 1, wherein said medium comprises a non-compressible substance.

3. An articulated bearing according to claim 1, wherein communication between said gap and said space is formed by a channel formed in one of said pot and said cover portion.

4. An articulated bearing according to claim 3, wherein said channel is formed in said end wall.

5. An articulated bearing according to claim 1, wherein said medium is a liquid.

6. An articulated bearing according to claim 1, wherein said medium comprises a plastic which is liquified upon being heated.

7. An articulated bearing according to claim 1, wherein said bearing pot is mounted to said supporting member, said end wall defining a bottom of said space.

8. An articulated bearing according to claim 1, wherein said recess is formed in said cover portion.

9. An articulated bearing according to claim 8, wherein said bearing pot is mounted to said supporting member, said end wall defining a bottom of said space.

10. An articulated bearing according to claim 1, wherein said recess is formed in said end wall.

11. An articulated bearing according to claim 10, wherein said bearing pot is mounted to said supporting member, said end wall defining a bottom of said space.

12. An articulated bearing according to claim 11, wherein said bearing journal has a crowned outer surface engaging a vertical surface of said bore.

13. An articulated bearing surface according to claim 12, wherein said crowned surface has a spherical curvature.

14. An articulated bearing according to claim 1, wherein said bearing journal is configured so as to be symmetrical about a vertical axis, and said recess comprising a cylindrical bore.

15. An articulated bearing according to claim 1, wherein said articulated bearing is elongated horizontally, and said recess comprising a groove.

16. An articulated bearing according to claim 1, wherein said end wall increases in thickness toward a center thereof.

17. An articulated bearing according to claim 16, wherein a surface of said end wall facing said opening is of generally conical shape.

18. An articulated bearing according to claim 1, wherein said seal comprises a sealing ring disposed horizontally between said side wall and a vertical outer side of said cover portion.

19. An articulated bearing according to claim 18, wherein said sealing ring includes horizontally spaced inner and outer sealing portions engaging said cover portion and said vertical wall, respectively, and a groove separating said inner and outer sealing portions, said groove communicating with said medium so that pressure from said medium pushes said inner and outer sealing portions away from one another.

20. An articulated bearing according to claim 1 including passage means for introducing said medium into said space while said cover portion is situated therein.

21. An articulated bearing according to claim 20, wherein said supported member is raisable in response to an increased volume of said medium within said space.

22. An articulated bearing according to claim 1, wherein said supported member is a bridge, and said supporting member is a bearing pad.

* * * * *